US009384715B2

(12) United States Patent
Taniguchi

(10) Patent No.: US 9,384,715 B2
(45) Date of Patent: Jul. 5, 2016

(54) KEYBOARD APPARATUS AND KEYBOARD INSTRUMENT

(71) Applicant: CASIO COMPUTER CO., LTD., Shibuya-ku, Tokyo (JP)

(72) Inventor: Hirokazu Taniguchi, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/662,130

(22) Filed: Mar. 18, 2015

(65) Prior Publication Data

US 2015/0269916 A1 Sep. 24, 2015

(30) Foreign Application Priority Data

Mar. 20, 2014 (JP) ..... 2014-058143

(51) Int. Cl.
*G10C 3/18* (2006.01)
*G10C 3/12* (2006.01)
*G10H 1/34* (2006.01)

(52) U.S. Cl.
CPC .. *G10C 3/18* (2013.01); *G10C 3/12* (2013.01); *G10H 1/346* (2013.01)

(58) Field of Classification Search
CPC ..... G10C 3/18; G10C 3/12
See application file for complete search history.

(56) References Cited

U.S. PATENT DOCUMENTS 1,353,646 A * 9/1920 George ..... G10C 3/22 84/440
2,185,734 A * 1/1940 Loar ..... G10C 1/06 84/174
5,022,302 A * 6/1991 Guyon ..... G10C 3/161 84/255
5,585,582 A * 12/1996 Stanwood ..... G10C 3/12 84/432
5,796,024 A * 8/1998 Stanwood ..... G10C 3/125 84/433
6,054,641 A * 4/2000 Inoue ..... G10H 1/344 84/171
6,096,959 A * 8/2000 Davide ..... G10C 3/12 84/432
6,248,943 B1 * 6/2001 Inoue ..... G10H 1/346 84/423 R
6,452,079 B2 * 9/2002 Sugiyama ..... G10H 1/346 84/423 R (Continued)

FOREIGN PATENT DOCUMENTS

JP 2002258835 A 9/2002

*Primary Examiner* — Robert W Horn
(74) *Attorney, Agent, or Firm* — Holtz, Holtz & Volek PC

(57) ABSTRACT

A keyboard apparatus is provided, which is provided with plural keys 2 disposed in parallel, plural transmission members 10 rotating in response to a key pressing operation on the plural keys, and plural hammer members 11 rotating in accordance with rotation of the transmission member to give an action load to the key. The weights of the transmission members together with the weights of the hammer members bring the plural keys to the initial positions and initial loads of the keys are adjusted by the weights of the hammer members. Even if the weight of the hammer member is changed, the initial load of the key can be adjusted based on the weight of the transmission member. Therefore, when the weights of the hammer members are changed, the initial loads of the keys can be kept constant on the high-pitched tone side and the low-pitched tone side.

16 Claims, 7 Drawing Sheets

(56) References Cited

U.S. PATENT DOCUMENTS

| | | | | |
|---|---|---|---|---|
| 6,649,821 | B2 * | 11/2003 | Inoue | G10C 3/12 84/423 R |
| 6,683,242 | B2 | 1/2004 | Inoue et al. | |
| 6,965,070 | B2 * | 11/2005 | Wenjun | G10C 3/161 84/719 |
| 7,193,147 | B2 * | 3/2007 | Ishida | G10C 3/12 84/35 |
| 7,279,627 | B2 * | 10/2007 | Tanaka | G10C 3/161 84/453 |
| 7,476,788 | B2 * | 1/2009 | Yoshisue | G10C 3/161 84/216 |
| 7,633,002 | B2 * | 12/2009 | Inouye | G10C 3/12 84/432 |
| 8,389,833 | B2 * | 3/2013 | Muramatsu | G10C 3/18 84/240 |
| 8,513,508 | B2 * | 8/2013 | Pancino | G10C 3/18 84/240 |
| 9,177,535 | B2 * | 11/2015 | Suzuki | G10C 3/12 |
| 2002/0035913 | A1 * | 3/2002 | Arimori | G10C 3/22 84/423 R |
| 2014/0083274 | A1 * | 3/2014 | Abe | G10C 3/16 84/251 |
| 2015/0269916 | A1 * | 9/2015 | Taniguchi | G10C 3/18 84/236 |

* cited by examiner

KEYBOARD APPARATUS AND KEYBOARD INSTRUMENT

CROSS-REFERENCE TO RELATED APPLICATION

The present application is based upon and claims the benefit of priority from the prior Japanese Patent Application No. 2014-058143 filed Mar. 20, 2014, the entire contents of which are incorporated herein by reference.

BACKGROUND OF THE INVENTION

1. Field of the Invention

The present invention relates to a keyboard apparatus which is used in musical instruments such as pianos, and relates to a keyboard instrument.

2. Description of the Related Art

In keyboard instruments such as conventional acoustic pianos, each of plural keys is provided with a mechanism which consists of a wippen which swings when a key is pressed, a jack driven in accordance with rotation of the wippen, and a hammer member driven by the jack to strike a string, as described in Japanese Unexamined Patent Publication No. 2002-258835.

In this mechanism, the keys are urged to swing upward by the total weight of the wippen, jack and hammer member, whereby the front ends of the keys are brought to the initial positions by initial loads. Therefore, the keyboard apparatus gives a player a constant initial load when he/she performs a key operation on the keyboard instrument.

But in the mechanism of the keyboard apparatus, when the weight of the hammer member is made heavier in a low-pitched tone side than in a high-pitched tone side to change a key load in performing a key operation between the low-pitched tone side and the high-pitched tone side, the key load at the initial position changes between the low-pitched tone side and the high-pitched tone side, giving the player something strange feeling when he/she plays the keyboard instrument. In the conventional acoustic piano, heavier weights are attached to the keys in the low-pitched tone side than in the high-pitched tone side, whereby the key loads of the keys in the initial positions are kept constant.

A key touch feeling similar to the key touch feeling given by the acoustic piano can be obtained with the above structure, but the additional weights to be attached on the keys already provided with the wippen, jack and hammer member will invite inconveniences including a high cost of the instrument and a complicated structure.

SUMMARY OF THE INVENTION

A keyboard apparatus is provided, which is simple in structure and gives a key touch feeling similar to key touch feeling given by acoustic pianos.

According to one aspect of the invention, there is provided a keyboard apparatus which comprises plural keys, plural transmission members provided for the plural keys respectively, each having one of plural kinds of weights, each of which displaces, when a corresponding key is pressed by a user, and plural hammer members provided for the plural keys respectively, each having one of plural kinds of weights, each of which swings in accordance with displacement of the corresponding transmission member, when the corresponding key is pressed by the user, thereby applying an action load onto the pressed key.

According to another aspect of the invention, there is provided a keyboard instrument which comprises plural keys, plural transmission members provided for the plural keys respectively, each having one of plural kinds of weights, each of which displaces, when a corresponding key is pressed by a user, plural hammer members provided for the plural keys respectively, each having one of plural kinds of weights, each of which swings in accordance with displacement of the corresponding transmission member, when the corresponding key is pressed by the user, thereby applying an action load onto the pressed key, plural switch units provided for the plural hammer members respectively, each of which generates an on-signal when pressed in response to swing of the corresponding hammer member, and a sound source which generates a musical signal in response to the on-signal generated by the switch unit.

DETAILED DESCRIPTION OF THE PREFERRED EMBODIMENTS

A keyboard apparatus used in an electronic keyboard instrument according to the embodiments of the invention will be described with reference to the accompanying drawings in detail.

Figure 1:
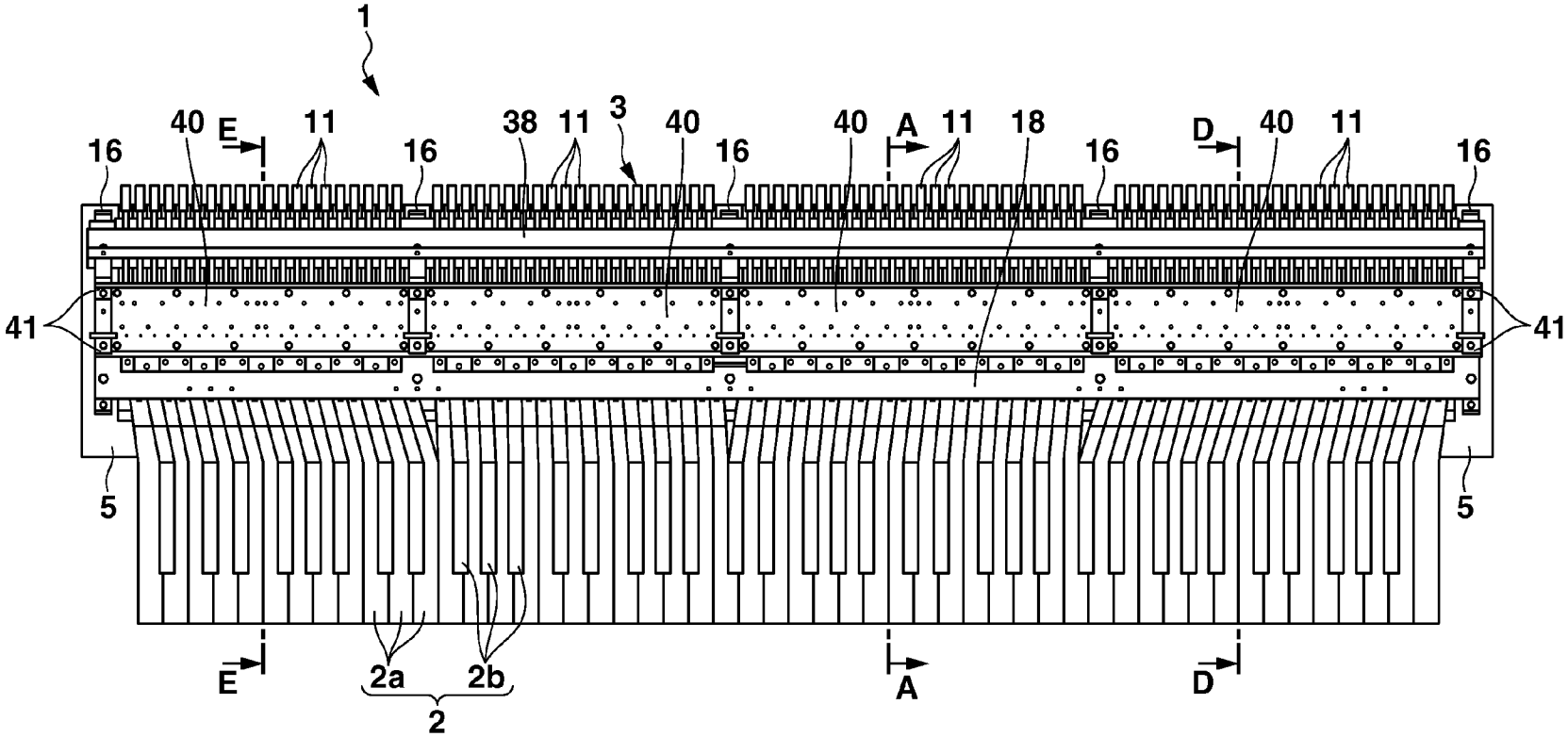
FIG. 1 is a plane view showing a keyboard apparatus used in an electronic keyboard instrument according to the embodiments of the present invention.
Figure 2:
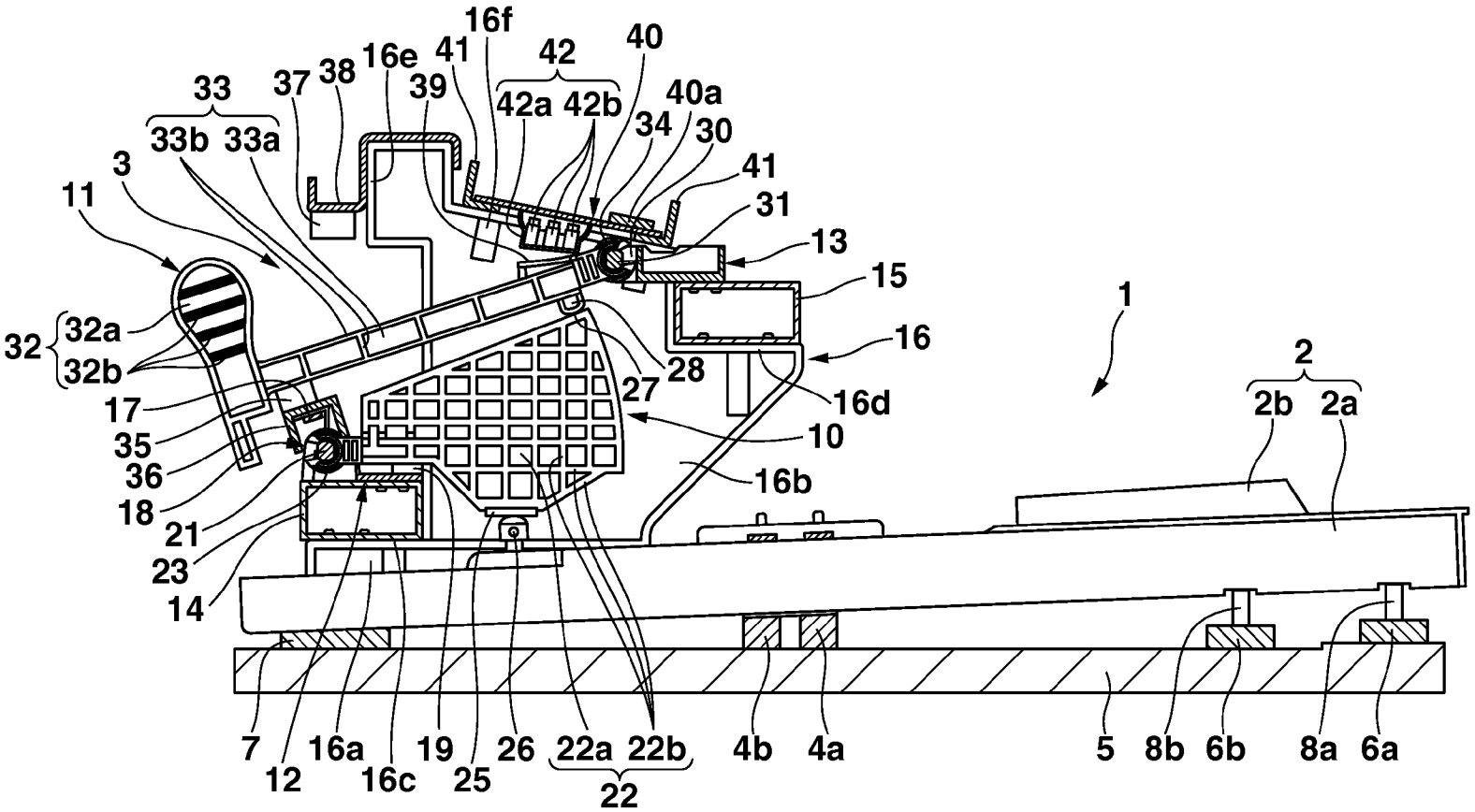
FIG. 2 is an enlarged sectional view of the keyboard apparatus, as seen along the line A-A in FIG. 1.

As shown in FIG. 1 and FIG. 2, the electronic keyboard instrument is provided with the keyboard apparatus 1. The keyboard apparatus 1 is assembled in the instrument case (not shown) of the electronic keyboard instrument. The keyboard apparatus 1 has plural keys 2 which are disposed in parallel and an action mechanism 3 which applies action loads to the keys in response to a key operation by a user, respectively.

The plural keys 2 consist of white keys 2*a* and black keys 2*b*, as shown in FIG. 1 and FIG. 2, and for example, 88 keys are disposed in parallel. The key 2 (2*a*, 2*b*) is rotatably supported by balance pins 4*a*, 4*b* approximately at its center portion, as clearly illustrated in FIG. 2. All of the plural keys are supported in this way and disposed in parallel on a base board 5.

Figure 3:
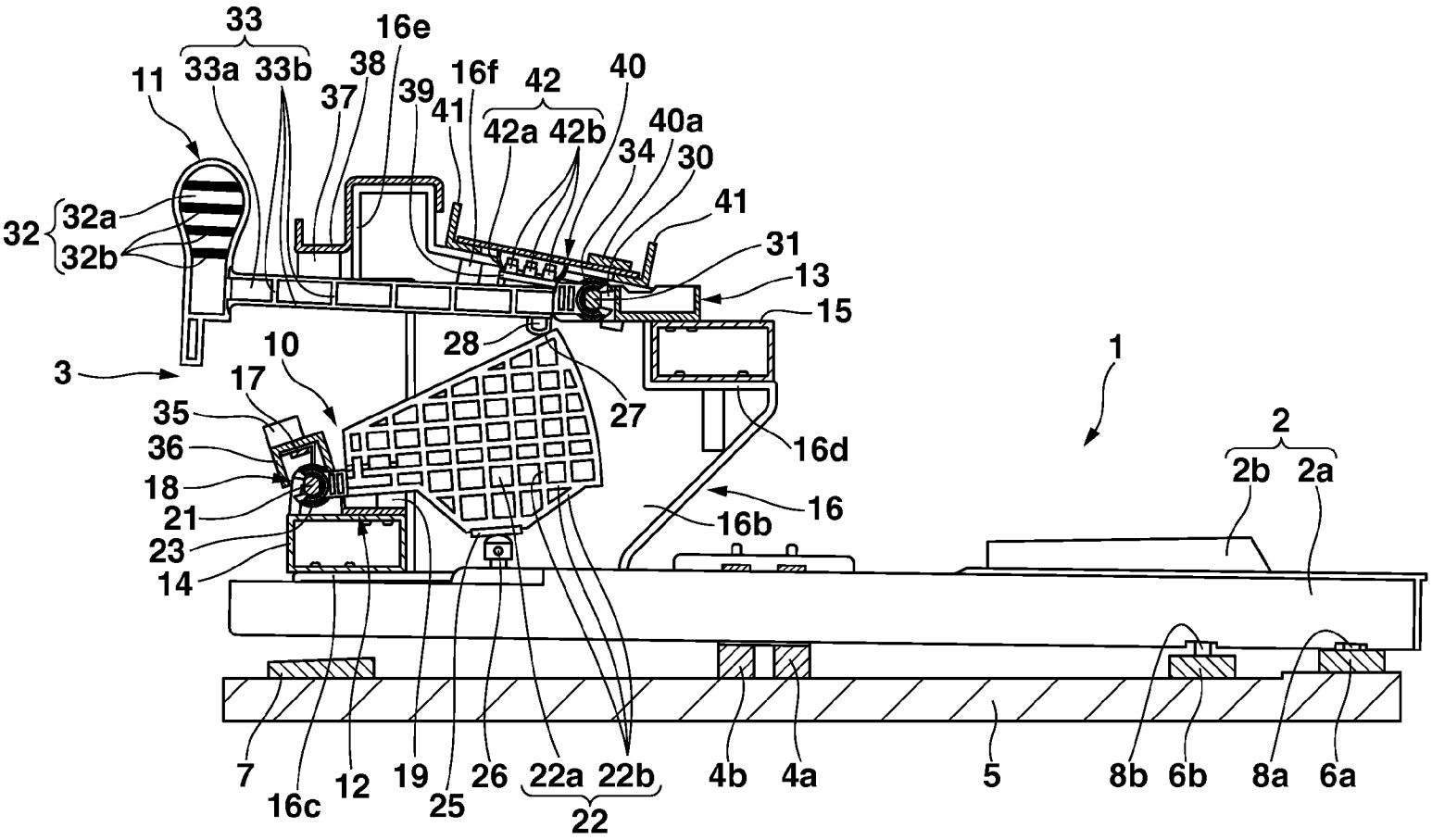
FIG. 3 is an enlarged sectional view of the keyboard apparatus (shown in FIG. 2) with a key pressed downward.

As shown in FIG. 2 and FIG. 3, there are provided cusion members 6*a*, 6*b* on the base board 5 along the direction in which the plural keys 2 are disposed in parallel, so as to receive and release the bottom face of the front end portion (the right side of the key 2 in FIG. 2) of the key 2. Further, the other cusion member 7 is provided on the base board 5 along the direction in which the plural keys 2 are disposed in parallel, so as to receive and release the bottom face of the rear end portion (the left side of the key 2 in FIG. 2) of the key 2. Furthermore, guide pins 8*a*, 8*b* are mounted on the base board 5 so as to stand up thereon for preventing the keys 2 from swaying in the direction in which the plural keys 2 are disposed in parallel.

An action mechanism 3 is provided with plural transmission members 10 and plural hammer members 11, as shown in FIG. 1, FIG. 2 and FIG. 3. The transmission member 10 swings in the vertical direction in response to a key pressing operation on the plural keys 2. The hammer member 11 also swings in the vertical direction in accordance with the rotation of the transmission member 10 to apply an action load onto the pressed key 2. The key 2 is urged to swing counter clockwise about the balance pins 4*a*, 4*b* by the weight of the transmission member 10 and the weight of the hammer member 11, whereby the key 2 is brought to an initial position, receiving an initial load.

Further, as shown in FIG. 2 and FIG. 3, the action mechanism 3 is provided with plural transmission holding parts 12 for rotatably holding the plural transmission members 10 and plural hammer holding parts 13 for rotatably holding the plural hammer members 11. The plural transmission holding parts 12 are mounted on a transmission supporting rail 14 which is arranged along the direction in which the plural keys 2 are disposed. The plural hammer holding parts 13 are mounted on a hammer supporting rail 15 which is arranged along the direction in which the plural keys 2 are disposed. The transmission supporting rail 14 and the hammer supporting rail 15 are supported by plural supporting members 16 and are arranged in the upper part of the plural keys 2.

The plural supporting members 16 are attached to the base board 5 at plural positions predetermined along the direction in which the plural keys 2 are arranged, so as to stand up on the base board 5, as shown in FIG. 1, FIG. 2 and FIG. 3. The plural keys, for instance, 88 keys are arranged in total (88-key arrangement). Then, the plural supporting members 16 are disposed, for example, at both ends of the 88-key arrangement and at 3 positions of every 20 keys of the 88-key arrangement. In other words, the supporting members 16 are disposed at 5 positions along the 88-key arrangement in the present embodiment.

The supporting member 16 is made of a hard synthetic resin such as ABS resin, and has a fixing part 16*a* to be attached to the base board 5 and a bridge part 16*b* integrally formed on the fixing part 16*a*, as shown in FIG. 2 and FIG. 3. When the fixing part 16*a* of the supporting member 16 is fixed to the base board 5, the bridge part 16*b* extends to the upper part of the rear end portion of the key 2.

A rear-side rail-supporting part 16*c* is provided at the lower portion of the rear end of the bridge part 16*b*, (that is, the portion corresponding to the upper portion of the rear side of the fixing part 16*a*), as shown in FIG. 2 and FIG. 3. The rear-side rail-supporting part 16*c* serves to support the transmission supporting rail 14. A front-side rail-supporting part 16*d* is provided at the front top portion of the bridge part 16*b* and serves to support the hammer supporting rail 15. Further, a stopper rail-supporting part 16*e* is provided at the upper portion of the rear end of the bridge part 16*b*, and a base-plate rail-supporting part 16*f* is provided at the top portion of the bridge part 16*b*.

The transmission supporting rail 14 is composed of a tubular member having a rectangular cross section and a length extending over the overall length of the 88-key arrangement, as shown in FIG. 2 and FIG. 3. The transmission supporting rail 14 is fixed to the rear-side rail-supporting part 16*c* of the supporting member 16 at plural positions predetermined along the direction of the 88-key arrangement.

The plural transmission holding parts 12 and plural stopper supporting parts 17 are mounted on the transmission supporting rail 14 along the direction of the 88-key arrangement (the direction in which the keys 2 are arranged), as shown in FIG. 2 and FIG. 3. The stopper supporting part 17 is made of a metal plate. Plural stopper supporting parts 17 are fixed to the transmission supporting rail 14 at five positions corresponding to the plural supporting members 16 so as to project over from the transmission holding parts 12.

Figure 4A:
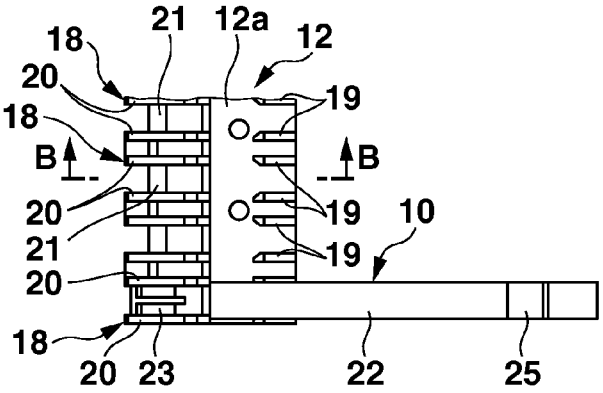
FIG. 4A is an enlarged plane view partially showing a transmission member and a transmission holding part shown in FIG. 2.
Figure 4B:
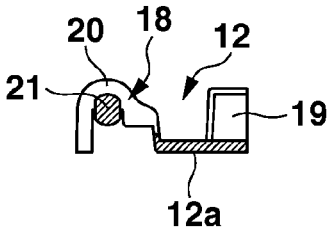
FIG. 4B is an enlarged sectional view of the transmission member and transmission holding part along the line B-B in FIG. 4A.

The transmission holding part 12 is made of a hard synthetic resin such as ABS resin, and integrally formed on a body plate 12*a* so as to face, for instance, about 10 keys 2 along the direction of the 88-key arrangement, as shown in FIG. 2, FIG. 3 and FIG. 4B. The transmission holding part 12 rotatably holds a transmission member 10, and has a shaft supporting part 18 for preventing the transmission member 10 from vibrating laterally and a restricting part 19 for restricting a lateral vibration of the transmission member 10 during transportation.

The shaft supporting part 18 has a pair of guide walls 20 formed on the rear end of the body plate 12*a* of the transmission holding part 12 (left end of the part 12 as seen in FIG. 4B) so as to face the keys 2 and a transmission holding shaft 21 formed between the pair of guide walls 20, as shown in FIG. 2, FIG. 3 and FIG. 4B. The pair of guide walls 20 serves as a guide unit which slidably supports the both sides of a transmission interlocking part 23 (to be described later) of the transmission member 10, guiding the transmission interlocking part 23 rotatably.

The restricting part 19 consists of a pair of restricting walls formed on the front end of the body plate 12*a* of the transmission holding part 12 (right end of the part 12 as seen in FIG. 4B), as shown in FIG. 2, FIG. 3 and FIG. 4B. The restricting part 19 is prepared for the transmission member 10, and holds both side of the rear portion of the transmission member 10, preventing the transmission member 10 from vibrating laterally during transportation.

The transmission member 10 is made of a hard synthetic resin such as ABS resin. The transmission member 10 consists of a transmission body 22 and the transmission interlocking part 23, as shown in FIG. 2 to FIG. 5B. The transmission body 22 swings in the vertical direction in response to a key operation on the keys 2 to make the hammer member 11 swing in the vertical direction. The transmission interlocking part 23 is integrally formed on the transmission body 22 and is rotatably held on the transmission holding shaft 21 of the transmission holding part 12.

Figure 5A:
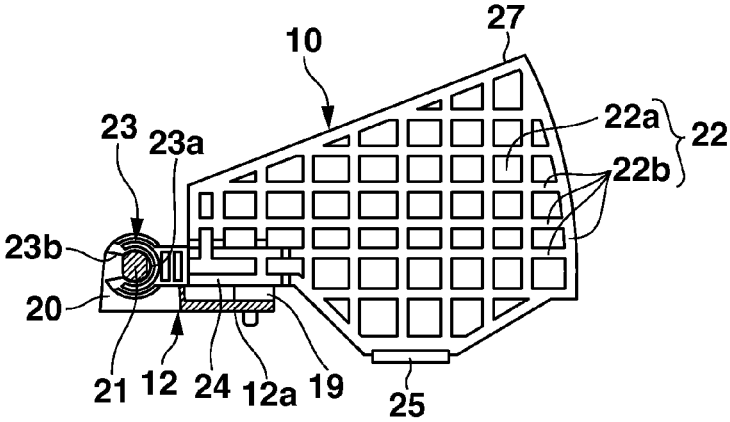
FIG. 5A is an enlarged side view of the transmission member and transmission holding part shown in FIG. 2.
Figure 5B:
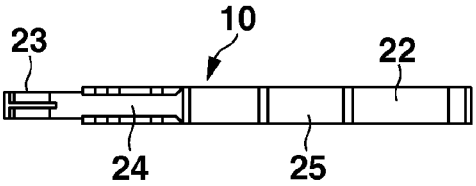
FIG. 5B is an enlarged bottom view of the transmission member.

The transmission body 22 is formed in a waffle-like shape, as shown in FIG. 2, FIG. 3 and FIG. 5B. In other words, the transmission body 22 consists of a vertical thin plate 22*a* and ribs 22*b* formed on the peripheral portion and the both surfaces of the vertical plate 22*a* as shown in FIG. 5A. The weight of the transmission body 22 can be adjusted depending on the shape of the vertical plate 22*a* and the density of the ribs 22*b*.

The transmission interlocking part 23 is reverse C-shaped on the whole and formed on the rear end of the transmission body 22 so as to extend rearward, as shown in FIG. 2 to FIG. 5B. More particularly, the transmission interlocking part 23 is formed so as to have substantially the same thickness in the direction of the 88-key arrangement as the distance between the pair of guide walls 20 of the shaft supporting unit 18, and is slidably inserted into between the pair of guide walls 20, as shown in FIG. 4A.

The transmission interlocking part 23 is formed with an interlocking hole 23*a* at its center for interlocking the transmission holding shaft 21 of the transmission holding part 12, as shown in FIG. 5A. The transmission interlocking part 23 has an insertion opening 23*b* prepared in the peripheral of the interlocking hole 23*a*, from which the transmission holding shaft 21 is inserted into the interlocking hole 23*a*, whereby the transmission interlocking part 23 is rotatably held by the transmission holding shaft 21.

When the transmission holding shaft 21 is inserted into the interlocking hole 23*a* through the insertion opening 23*b*, the transmission interlocking part 23 is vertically held on the transmission holding shaft 21 so as to make the insertion opening 23*b* face the transmission holding shaft 21 and then resiliently pressed against the transmission holding shaft 21, whereby the transmission holding shaft 21 is inserted into and interlocked by the interlocking hole 23*a*, as shown in FIG. 5A.

A thin engaging part 24 is provided at the rear bottom portion of the transmission body 22 of the transmission member 10, as shown in FIG. 2, FIG. 3, FIG. 5A and FIG. 5B. The engaging part 24 is restricted its movement by the restricting part 19 of the transmission holding part 12. The transmission body 22 is shaved thin at the both surfaces of its rear bottom portion to form the engaging part 24 having substantially the same thickness as a distance between a pair of restricting walls of the restricting part 19, as shown in FIG. 5B. Then, the engaging part 24 formed in this way is inserted into between the restricting walls of the restricting part 19 to rotatably guide the transmission member 10 and also serves to prevent the transmission member 10 from vibrating laterally during transportation.

Further, the transmission body 22 of the transmission member 10 is formed so as to extend its bottom portion toward the key 2, as shown in FIG. 2, FIG. 3, FIG. 5A and FIG. 5B. The transmission body 22 is provided with a first transmission felt 25 at its bottom portion. The first transmission felt 25 is in contact with a capstan 26 provided on the rear of the key 2.

In the mechanism described above, when the key 2 is pressed, the capstan 26 comes from beneath to contact with the first transmission felt 25, moving the transmission member 10 upward to swing the transmission member 10 counterclockwise about the transmission holding shaft 21. The transmission body 22 of the transmission member 10 is shaped higher at its front-end top than the rear-end top, and has a left-downward slope section on the top (for instance, as seen in FIG. 5A).

On the front-end top of the transmission body 22 is provided a second transmission felt 27, as shown in FIG. 2, FIG. 3, FIG. 5A and FIG. 5B. As will be described later, a hammer projection 28 of the hammer member 11 comes from above to contact with the second transmission felt 27. When the key 2 is pressed to swing the transmission member 10 counterclockwise about the transmission holding shaft 21, the transmission member 10 moves the hammer projection 28 of the hammer member 11 upward, rotating the hammer member 11 in the clockwise direction.

Meanwhile, the hammer supporting rail 15 is composed of a tubular member having a rectangular cross section and a length extending over the overall length of the 88-key arrangement, like the transmission supporting rail 14 as shown in FIG. 2, and FIG. 3. The hammer supporting rail 15 is fixed to the front-side rail-supporting part 16*d* of the supporting members 16 at plural positions predetermined along the direction of the 88-key arrangement. Plural hammer holding parts 13 are fixed to the hammer supporting rail 15 along the direction in which the keys are arranged.

The hammer holding part 13 is made of a hard synthetic resin such as ABS resin, and has a holding member integrally formed on the rear of its body plate 13*a* for holding the hammer members 11. The body plate 13*a* has the form of rails and the holding member faces, for instance, about 10 keys 2 along the direction of the 88-key arrangement, as shown in FIG. 2, FIG. 3, FIG. 6A and FIG. 7.

Figure 6A:
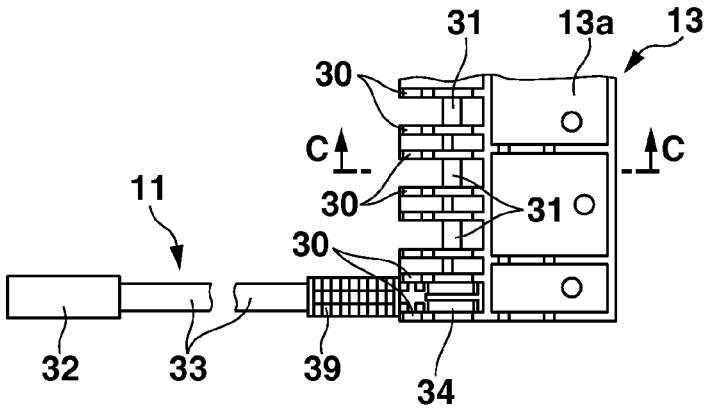
FIG. 6A is an enlarged plane view partially showing a hammer member and a hammer holding part shown in FIG. 2.
Figure 7:
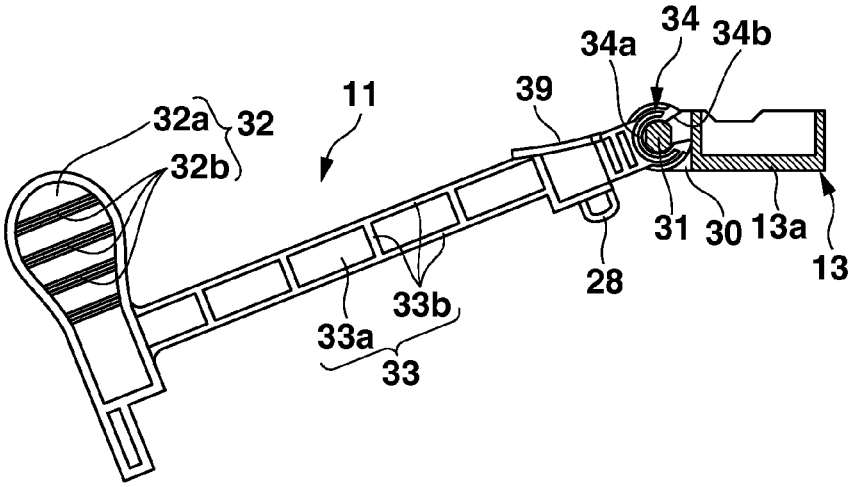
FIG. 7 is an enlarged side view of the hammer member and hammer holding part shown in FIG. 6A.

More particularly, the hammer holding part 13 has a pair of guide walls 30 formed on the rear end portion (left end portion) of the body plate 13*a* so as to correspond to the transmission member 10 and a hammer holding shaft 31 held between the pair of guide walls 30, as shown in FIG. 6A and FIG. 7. The pair of guide walls 30 holds a hammer interlocking part 34 (to be described later) of the hammer member 11 between the guide walls 30, rotatably guiding the hammer interlocking part 34 of the hammer member 11.

The hammer member 11 is made of a hard synthetic resin such as ABS resin, and has a hammer 32 and a hammer arm 33, these elements being integrally formed, as shown in FIG. 2, FIG. 3, FIG. 6A and FIG. 7. The hammer 32 has a ladle-shaped plate part 32*a* with ribs 32*b* formed on its peripheral and on both surfaces. The weight of the hammer 32 is adjusted depending on the shape of the ladle-shaped plate part 32*a* and the density and shape of the ribs 32*b*.

The hammer arm 33 consists of a lateral plate part 33*a* having substantially the same length as the transmission member 10 with ribs 33*b* formed on its peripheral and on both surfaces, as shown in FIG. 2, FIG. 3, FIG. 6A and FIG. 7. The hammer arm 33 is integrally formed with the hammer interlocking part 34 at its front end portion (the right end portion of the hammer arm 33 shown in FIG. 7). The hammer arm 33 is rotatably connected to the hammer holding part 13 through the hammer interlocking part 34.

Figure 6B:
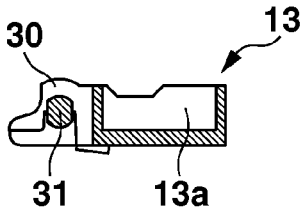
FIG. 6B is an enlarged sectional view of the hammer member and hammer holding part along the line C-C in FIG. 6A.

The hammer interlocking part 34 is C-shaped on the whole and formed on the front end of the hammer arm 33 so as to project forward, as shown in FIG. 7. More precisely, the hammer interlocking part 34 is formed so as to have substantially the same thickness in the direction of the 88-key arrangement as the distance between the pair of guide walls 30 of the shaft supporting unit 18, and is slidably inserted into between the pair of guide walls 30, as shown in FIG. 6A and FIG. 6B.

The hammer interlocking part 34 is formed with an interlocking hole 34*a* at its center for interlocking the hammer holding shaft 31 of the hammer holding part 13, as shown in FIG. 7. The hammer interlocking part 34 has an insertion opening 34*b* prepared in the peripheral of the interlocking hole 34*a*, from which the hammer holding shaft 31 is inserted into the interlocking hole 34*a*, whereby the hammer interlocking part 34 is rotatably held by the hammer holding shaft 31.

When the hammer holding shaft 31 is inserted into the interlocking hole 34*a* through the insertion opening 34*b*, the hammer member 11 is vertically held on the hammer holding shaft 31 so as to make the insertion opening 34*b* face the hammer holding shaft 31 and then resiliently pressed against the hammer holding shaft 31, whereby the hammer holding shaft 31 is inserted into and interlocked by the interlocking hole 34*a*, as shown in FIG. 7.

The hammer arm 33 is provided with the hammer projection 28 at its front end bottom, as shown in FIG. 2, FIG. 3 and FIG. 7. The hammer projection 28 is in contact with the top of the second transmission felt 27 provided on the front-end top of the transmission body 22 of the transmission member 10. When the transmission member 10 swings in the clockwise direction, the hammer projection 28 of the hammer member 11 is pushed upward, whereby the hammer member 11 is made to swing in the clockwise direction about the hammer holding shaft 31 of the hammer holding part 13.

The hammer arm 33 comes to its initial position, that is, to its lower limit position, as shown in FIG. 2 and FIG. 3, when its rear-end bottom of the hammer arm 33 is brought from above to contact with a lower limit stopper 35. More specifically, the lower limit stopper 35 is attached to a lower limit stopper rail 36 supported by the plural stopper supporting parts 17 provided on the transmission supporting rail 14. The transmission member 10 is forced to its initial position, when the rear-end bottom of the hammer arm 33 comes from above to contact with the lower limit stopper 35.

When the rear-end top of the hammer arm 33 comes from beneath to contact with an upper limit stopper 37, an upper limit position of the hammer arm 33 is defined, as shown in FIG. 2 and FIG. 3. More specifically, the upper limit stopper 37 is attached to the bottom surface of an upper limit stopper rail 38 fixed to each stopper rail-supporting part 16*e* of the supporting members 16.

When the hammer arm 33 swings in the clockwise direction about the hammer holding shaft 31 of the hammer holding part 13, the rear-end top of the hammer arm 33 comes from beneath to contact with the upper limit stopper 37, whereby an upper limit position of the hammer member 11 is defined, as shown in FIG. 2 and FIG. 3.

A switch pressing part 39 is provided on the front-end top of the hammer arm 33, as shown in FIG. 2, FIG. 3 and FIG. 7. A switch substrate 40 is arranged at the upper part of the switch pressing part 39 of the hammer arm 33 by a pair of substrate supporting rails 41. The substrate supporting rail 41 is an elongated plate which is C-shaped in cross section and has a length extending over the whole length of the 88-key arrangement.

The horizontal portion of the substrate supporting rail 41 is fixed to the base-plate rail-supporting part 16*f* of the supporting member 16 at prescribed distance separated positions, as shown in FIG. 1 to FIG. 3. The switch substrate 40 is separated into plural plates as shown in FIG. 1. In the present embodiment of the invention, the switch substrate 40 is separated into 4 plates, and each plate has a length corresponding to about 20 keys and is fixed to one pair of substrate supporting rails 41.

As shown in FIG. 2 and FIG. 3, there are provided gum switches 42 beneath the switch substrate 40. The gum switches 42 are mounted on an elongated gum sheet extending along the direction of the 88-key arrangement, and consist of plural groups of round-head projections 42*a* prepared corresponding respectively to the plural hammer arms 33. Inside the projections 42*a*, there are provided plural movable contacts 42*b* which are disposed along the hammer arm direction and are to be contact with plural fixed contacts (not shown) prepared beneath the switch substrate 40.

When the hammer member 11 is turned clockwise about the hammer holding shaft 31 of the hammer holding part 13 and the gum switch 42 is pressed from beneath by the switch pressing part 39 of the hammer arm. 33, as shown in FIG. 3, the round-head projections 42*a* are elastically deformed and after a while make the plural movable contacts 42*b* successively contact with the plural fixed contacts, whereby a switch signal depending on pressing force applied to the key 2 is output.

The present keyboard apparatus 1 is arranged such that key-touch feeling stepwisely changes in the high-pitched tone side and the low-pitched tone side. More specifically, inertial moments of the hammer members 11 are set in the keyboard apparatus 1 such that the inertial moment stepwisely changes to reduce on the high-pitched tone side and to increase on the low-pitched tone side. Therefore, in the keyboard apparatus 1, the action load of key-pressing operation is reduced on the high-pitched tone side and is increased on the low-pitched tone side.

Figure 8:
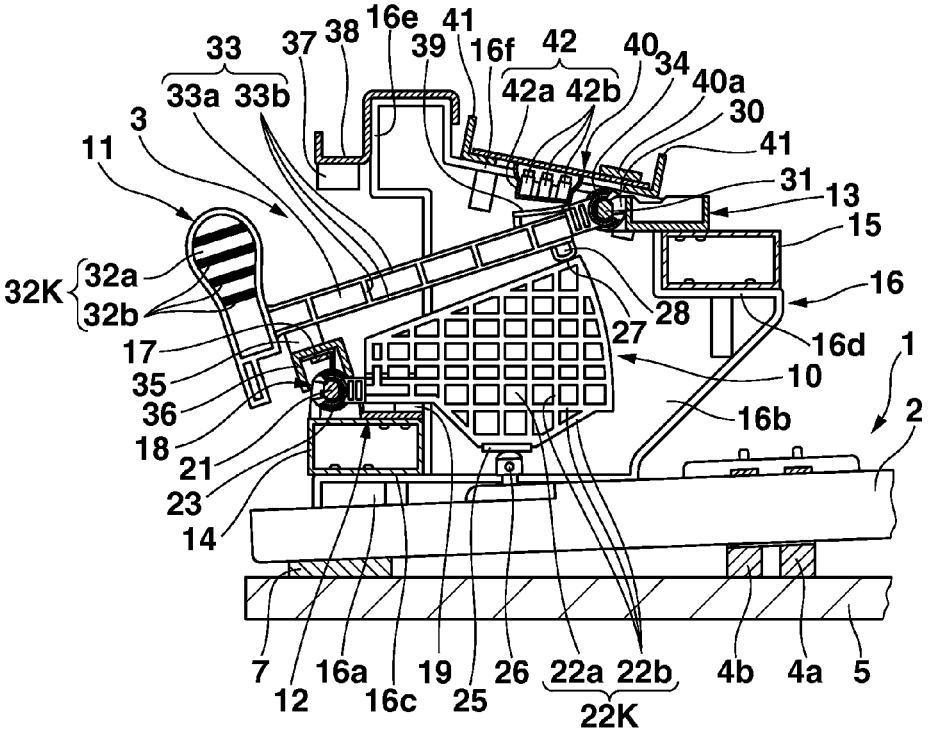
FIG. 8 is an enlarged sectional view of the keyboard apparatus on a high-pitched tone side, as seen along the line D-D in FIG. 1.
Figure 9:
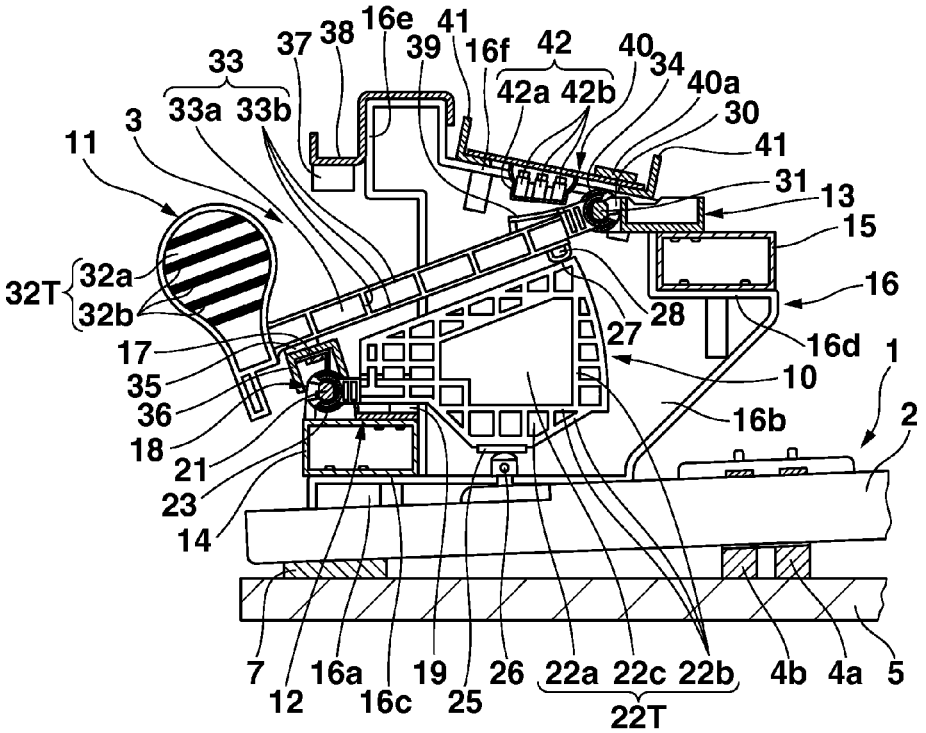
FIG. 9 is an enlarged sectional view of the keyboard apparatus on a low-pitched tone side, as seen along the line E-E in FIG. 1.

In the keyboard apparatus 1, the hammer members are made heavy in weight on the high-pitched tone side and are made light in weight on the low-pitched tone side, as shown in FIG. 8 and FIG. 9. More specifically, the hammers 32K (FIG. 8) in the high-pitched tone side are made smaller in shape than the hammers 32T (FIG. 9) in the low-pitched tone side. Therefore, if the hammer arms 33 have the same length and the same weight, the inertial moments of the hammer members 11 will be lower on the high-pitched tone side than on the low-pitched tone side.

Meanwhile, each of the plural transmission members 10 is made such that the total weight of its own weight and the weight of the corresponding hammer member 11 will be equivalent in the high-pitched tone side and the low-pitched tone side, as shown in FIG. 8 and FIG. 9. More specifically, the weight of the transmission member 10 in the high-pitched tone side is made heavier than in the low-pitched tone side to compensate the difference in weight of the hammer member 11 between the high-pitched tone side and the low-pitched tone side, whereby initial loads of the plural keys 2 are kept constant.

The plural transmission members 10 push up the plural keys 2 to the initial positions with their own weights and the weights of the plural hammer members 11, as shown in FIG. 8 and FIG. 9, and the initial loads of the plural keys 2 are adjusted depending on the weights of the plural hammer members 11. Receiving the weights of the transmission members 10 and the plural hammer members 11, the plural keys 2 turn counterclockwise about the balance pins 4*a*, 4*b* and are pushed up to their initial positions to receive approximately equivalent initial loads.

The transmission body 22 of the transmission member 10 has the vertical plate 22*a* and the ribs 22*b* formed on the vertical plate 22*a*, as shown in FIG. 5A, FIG. 8 and FIG. 9, and these parts are integrally formed with the hard synthetic resin. The weight of the transmission body 22 is adjusted depending on the shape of the vertical plate 22*a* and the density of the ribs 22*b* formed thereon.

In the transmission body 22K (FIG. 8) in the high-pitched tone side, the vertical plate 22*a* is formed in a simple lattice and the ribs 22*b* are formed in high density, as shown in FIG. 8. As described, the transmission body 22K (FIG. 8) in the high-pitched tone side is made heavier than the transmission body 22T (FIG. 9) in the low-pitched tone side on the basis of the weight of the hammer member 11 in the high-pitched tone side, that is, the weight of the hammer member 32K in the high-pitched tone side.

In the transmission body 22T (FIG. 9) in the low-pitched tone side, the vertical plate 22*a* is formed with a hole 22*c* and the ribs 22*b* are formed thereon in low density, as shown in FIG. 9. As described, the transmission body 22T (FIG. 9) in the low-pitched tone side is made lighter in weight than the transmission body 22K (FIG. 9) in the high-pitched tone side in the basis of the weight of the hammer member 11 in the low-pitched tone side, that is, the weight of the hammer member 32T in the low-pitched tone side.

Now, the operation of the keyboard apparatus 1 of the electronic keyboard instrument will be described. In the keyboard apparatus 1, key operation is performed on the keys 2. When the key 2 is pressed as shown in FIG. 3, the key 2 turns clockwise about the balance bins 4*a*, 4*b* and the capstan 26 of the key 2 pushes the transmission member 10 upward, whereby the transmission member 10 swings counterclockwise about the transmission holding shaft 21 of the transmission holding part 12.

Since the transmission holding shaft 21 of the transmission holding part 12 is interlocked in the interlocking hole 23*a* of the transmission interlocking part 23 of the transmission member 10, the transmission member 10 does not displace on the key 2 and smoothly turns counterclockwise about the transmission holding shaft 21. Further, since the transmission interlocking part 23 of the transmission member 10 is slidably held between the pair of guide walls 20, the transmission member 10 turns smoothly without vibrating laterally.

When the transmission member 10 is pushed upward by the capstan 26 of the key 2, then the transmission member 10 turns counterclockwise and its second felt 27 pushes the hammer projection 28 of the hammer member 11 upward, whereby the hammer member 11 turns clockwise about the hammer holding shaft 31 of the hammer holding part 13, applying the action load to the key 2.

Since the hammer holding shaft 31 of the hammer holding part 13 is interlocked in the interlocking hole 34*a* of the hammer interlocking part 34 of the hammer member 11, the hammer member 11 does not displace on the key 2 and smoothly turns counterclockwise about the hammer holding shaft 31. Further, since the hammer interlocking part 34 of the hammer member 11 is slidably held between the pair of guide walls 30, the hammer member 11 turns smoothly without vibrating laterally.

When the hammer member 11 turns clockwise about the hammer holding shaft 31 of the hammer holding part 13, the inertial moment of the hammer member 11 applies the action load to the key 2. More specifically, the hammer arm 33 has substantially the same length as the length of the transmission member 10 in the direction of the key 2, and is formed with the hammer 32 at its rear portion of the hammer arm 33. The hammer interlocking part 34 of the hammer arm 33 with the hammer 32 formed at its rear end is rotatably interlocked to the hammer holding shaft 31.

When the hammer member 11 swings clockwise about the hammer holding shaft 31, an inertial moment is generated in the hammer member 11, applying the action load to the key 2, whereby a key touch feeling like a key touch feeling given by an acoustic piano is given.

When the hammer member 11 swings clockwise about the hammer holding shaft 31, the switch pressing part 39 of the hammer arm 33 presses from beneath the round-head projections 42*a* of the gum switches 42. Then, the round-head projections 42*a* are elastically deformed and after a while make the plural movable contacts 42*b* successively contact with the plural fixed contacts, whereby a switch signal depending on pressing force applied to the key 2 is output, and a musical tone is generated form a speaker (not shown).

Further, when the hammer member 11 swings clockwise about the hammer holding shaft 31, the rear-end top of the hammer arm 33 comes from beneath to the upper limit stopper 37 and the further rotation of the hammer member 11 is restricted. When the key 2 is released thereafter, the transmission member 10 turns clockwise under its own weight and returns to its initial position and at the same time the hammer member 11 turns counterclockwise under its own weight and returns to its initial position.

In the keyboard apparatus 1 according to the embodiment of the invention, the hammer member 11 is lighter in weight in the high-pitched tone side than in the low-pitched tone side and is lower in inertial moment on the high-pitched tone side than on the low-pitched tone side. Therefore, when the key 2 on the high-pitched tone side is pressed, a light action load is applied to the key 2 and a soft key touch feeling is given.

Since the hammer member 11 is heavier in weight in the low-pitched tone side than in the high-pitched tone side and is larger in inertial moment on the low-pitched tone side than on the high-pitched tone side. Therefore, when the key 2 on the low-pitched tone side is pressed, a heavy action load is applied to the key 2 and a heavy key touch feeling is given. Even though any of the keys 2 on the low-pitched tone side and on the high-pitched tone side should be pressed, a key touch feeling like the key touch feeling given by the acoustic piano will be obtained.

As described above, the keyboard apparatus 1 of the electronic keyboard instrument comprises the plural keys 2 disposes in parallel, the plural transmission members 10 corresponding respectively to the plural keys 2, and the plural hammer members 11 corresponding respectively to the plural transmission members 10. When the key 2 is pressed, the transmission member 10 corresponding to the pressed key 2 displaces and the weight of said transmission member 10 is determined on the basis of the pressed key 2. When the key 2 is pressed, the hammer member 11 turns in accordance with displacement of the transmission member 10, applying an action load to the pressed key 2. In the case where one of the plural transmission member 10 is heavier than others, the hammer member 11 corresponding to the one transmission member 10 is made lighter in weight than others, whereby a key touch feeling like the key touch feeling given by the acoustic piano can be obtained.

In the keyboard apparatus 1, even though the plural hammer members 11 are made different in weight, the plural transmission members 10 push the plural keys 2 up to their initial positions. Therefore, since the initial loads to be applied to the plural keys 2 can be adjusted on the basis of the respective weights of the plural hammer members 11, the initial loads applied to the keys 2 can be kept approximately constant, even though the weights of the plural hammer members 11 are made different between the high-pitched tone side and the low-pitched tone side. Further, the action load which is to be applied to the key 2 when the key 2 is pressed can be changed between the high-pitched tone side and the low-pitched tone side, whereby a key touch feeling like the key touch feeling given by the acoustic piano can be obtained.

Further, in the keyboard apparatus 1, the inertial moments corresponding respectively to the weights of the plural hammer members 11 are set low on the high-pitched tone side and are set large on the low-pitched tone side, and therefore, when the key 2 is pressed, a lighter action load can be applied to the key 2 on the high-pitched tone side than on the low-pitched tone side. As a result, a key touch feeling like the key touch feeling given by the acoustic piano can be obtained.

The plural hammer members 11 are made light in weight on the high-pitched tone side and are made heavy on the low-pitched tone side, and the plural transmission members 10 are made heavy on the high-pitched tone side and are made light in weight on the low-pitched tone side, compensating the difference in weights of the hammer members between the high-pitched tone side and the low-pitched tone side, whereby the initial loads of the keys 2 are kept approximately constant between the high-pitched tone side and the low-pitched tone side. As a result, a key touch feeling like the key touch feeling given by the acoustic piano can be obtained.

As described above, the hammer member 11 consists of the hammer 32 and the hammer arm 33, both being integrally formed from the synthetic resin. Therefore, the weight of the hammer member 11 can be changed to be used for the high-pitched tone side or for the low-pitched tone side without any restriction, whereby it is easy and simple to make the inertial moment of the hammer member 11 lower on the high-pitched tone side than on the low-pitched tone side.

In other words, the weight of the hammer member 11 is adjusted by the shape of the hammer 32. Therefore, it is possible to easily and simply reduce more weight of the hammer member 11 on the high-pitched tone side than on the low-pitched tone side by making the shape of the hammer member 11 smaller on the high-pitched tone side than on the low-pitched tone side. As a result, it is possible to reduce more inertial moment of the hammer member 11 on the high-pitched tone side than on the low-pitched tone side by setting the weights and lengths of the hammer arms 33 equivalent on the high-pitched tone side and on the low-pitched tone side.

The hammer 32 of the hammer member 11 has the ladle-shaped plate part 32*a* and the ribs 32*b* formed on the peripheral and the both surfaces of the plate part 32*a*. The hammer arm 33 of the hammer member 11 has the lateral plate part 33*a* and the ribs 33*b* formed on the peripheral and the both surfaces of the plate part 33*a*. Even though the plate parts 32*a* and 33*a* are made thin, it is possible to make these plates parts 32*a* and 33*a* strong enough with the ribs 32*b* and 33*b* formed thereon, and also when the hammer member 11 is formed, it is possible to prevent from producing shrinkage holes in the plates parts 32*a* and 33*a* with the ribs 32*b* and 33*b* and to form the hammer member 11 with high accuracy.

As described above, the transmission body 22 of the transmission member 10 has the vertical thin plate 22*a* and the ribs 22*b* formed on the peripheral portion and on the both surfaces of the vertical plate 22*a*, both being integrally formed from the synthetic resin. Therefore, when the transmission member 10 is formed, it is possible to change the weight of the transmission member 10 without any restriction to be used for the high-pitched tone side or for the low-pitched tone side.

It is possible to easily and simply make the transmission members 10 heavier for the high-pitched tone side than for the low-pitched tone side. Also, even though the vertical plate 22*a* is made thin, it is possible to make the transmission body 22 strong enough with the ribs 22*b*. Further, when the transmission member 10 is formed, it is possible to prevent from producing shrinkage holes in the vertical plate 22*a* with the ribs 22*b* and to form the transmission member 10 with high accuracy.

The weight of the transmission member 10 is adjusted depending on the shape of the transmission body 22 and the density of the ribs 22*b*. Therefore, it is possible to easily and simply increase more weight of the transmission member 10 for the high-pitched tone side than for the low-pitched tone side by making the shape of the transmission body 22 smaller in the high-pitched tone side than in the low-pitched tone side.

Even if the hammer members 11 are heavier in the high-pitched tone side than in the low-pitched tone side, and the different action loads should be applied to the key on the high-pitched tone side and to the key on the low-pitched tone side, respectively, the initial loads applied to the keys on the high-pitched tone side and on the low-pitched tone side can be kept approximately constant by increasing more weight of the transmission member 10 in the high-pitched tone side than in the low-pitched tone side.

In the above description, the embodiment has been described, in which the hammers 32 of the hammer member 11 are different in size between the high-pitched tone side and the low-pitched tone side. As in the modified embodiments shown in FIG. 10A and FIG. 10B, it is possible to provide holes 45*c* of different sizes in a plate 45*a* of the hammers 45K on the high-pitched tone side and in a plate 45*a* of the hammers 45T on the low-pitched tone side, respectively.

Figure 10A:
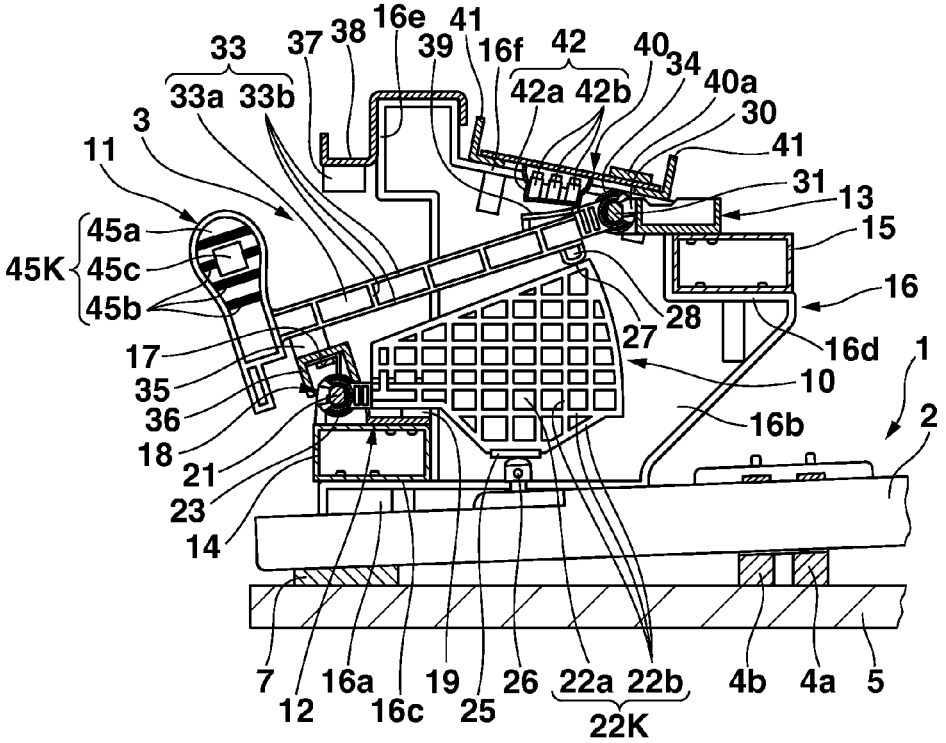
FIG. 10A is an enlarged sectional view of an essential part of a modified hammer member on the high-pitched tone side.
Figure 10B:
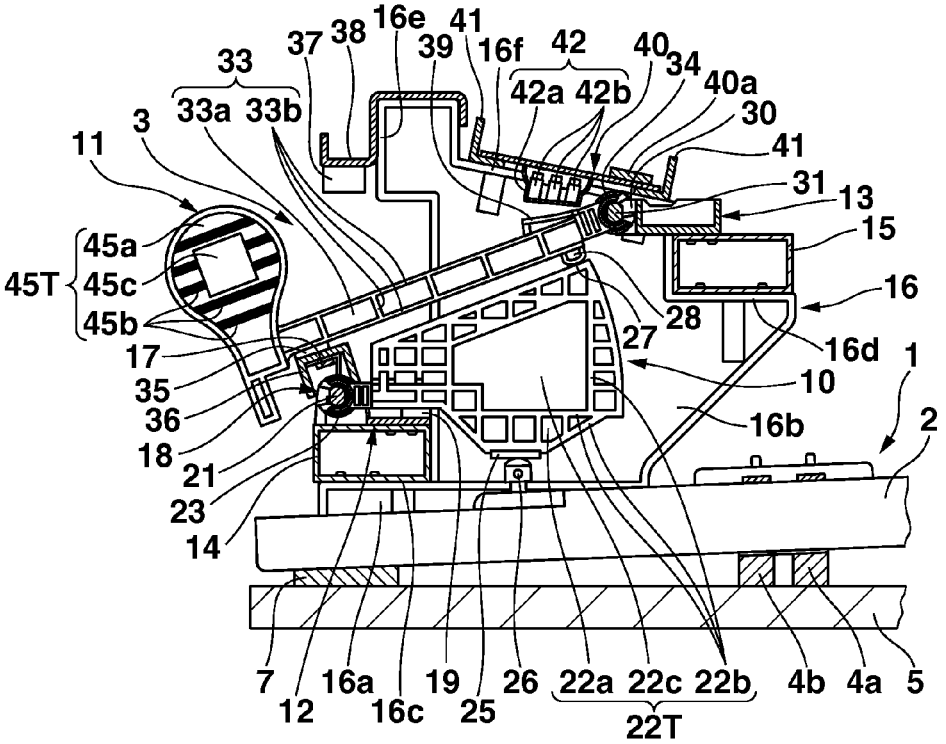
FIG. 10B is an enlarged sectional view of an essential part of the modified hammer member on the low-pitched tone side.

The hammers 45K on the high-pitched tone side shown in FIG. 10A are made smaller in size than the hammers 45T on the low-pitched tone side shown in FIG. 10B. A small square hole 45*c* is made in the plate 45*a* of the hammer 45K on the high-pitched tone side and the ribs 45*b* are formed in low density. Therefore, the hammer members 11 are made lighter in weight in the high-pitched tone side than the hammer members 11 in the low-pitched tone side.

The hammers 45T in the low-pitched tone side shown in FIG. 10B are made larger in size than the hammers 45K in the high-pitched tone side shown in FIG. 10A. A large square hole 45*c* is made in the plate 45*a* of the hammer 45T in the low-pitched tone side and the ribs 45*b* are formed in high density. Therefore, the hammer members 11 are made heavier in weight in the low-pitched tone side than the hammer members 11 in the high-pitched tone side.

The transmission members 10 are made heavier in the high-pitched tone side than in the low-pitched tone side to compensate the difference in weight of the hammer members 11 between on the high-pitched tone side and on the low-pitched tone side, keeping the initial loads of the plural keys 2 constant. Then, the plural transmission members 10 push up the plural keys 2 to their initial positions with their own weights and the weights of the plural hammer members 11, and the initial loads of the plural keys 2 are adjusted depending on the weights of the plural hammer members 11.

With the above arrangement, it is possible to easily and simply change the weight of the hammer 45K or 45T in the high-pitched tone side or in the low-pitched tone side by simply changing the size of the hole 45*c* to be made in the plate 45*a* of the hammer 45K or 45T, whereby the key touch feeling can be changed finely between the high-pitched tone side and the low-pitched tone side.

The embodiment has been described, in which the key touch feeling is set so as to change stepwisely throughout the high-pitched tone side and the low-pitched tone side. The arrangement of the key touch feeling is not restricted to the embodiment but it is possible to change the key touch feeling successively from the high-pitched tone side to the low-pitched tone side.

Although specific embodiments of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

In the modified embodiment shown in FIG. 10A and FIG. 10B, it is possible to make both the hammer 45K in the high-pitched tone side and the hammer 45T in the low-pitched tone side equivalent in shape and to make the holes different in size in the hammers 45K and 45T, respectively, whereby it is possible to change the weight of the hammer member 11 between the high-pitched tone side and the low-pitched tone side.

In the embodiments, it is possible to adjust the features of the hammer member and the transmission member depending on materials to be used as the hammer member and the transmission member and sizes shapes thereof. It is not always required to use all the methods described herein to adjust the features of the hammer member and the transmission member, but it will be possible to use some of them to adjust them.

Further, as elements for transferring the key pressing power, mechanical elements can be used, which do not swing but displace (move) when the key is pressed.

What is claimed is:

1. A keyboard apparatus comprising:

plural keys;

plural transmission members provided for the plural keys respectively, each having one of plural kinds of weights, each of which displaces, when a corresponding key is pressed by a user; and plural hammer members provided for the plural keys respectively, each having one of plural kinds of weights, each of which swings in accordance with displacement of the corresponding transmission member, when the corresponding key is pressed by the user, thereby applying an action load onto the pressed key.

2. The keyboard apparatus according to claim 1, wherein when a weight of one hammer member corresponding to one of the transmission members is lighter than a hammer member corresponding to the other transmission member, the weight of the one transmission member is made heavier than the other transmission member.

3. The keyboard apparatus according to claim 1, wherein inertia moments of the weights of the hammer members are set lower in a high-pitched tone side than in a low-pitched tone side.

4. The keyboard apparatus according to claim 1, wherein the plural hammer members are made lighter in weight in a high-pitched tone side than in a low-pitched tone side, and the plural transmission members are made heavier in weight in the high-pitched tone side than in the low-pitched tone side, whereby initial loads of the respective keys are kept approximately constant.

5. The keyboard apparatus according to claim 1, wherein the hammer member consists of a hammer portion and a hammer arm, the hammer portion and the hammer arm forming a single component of a synthetic resin.

6. The keyboard apparatus according to claim 5, wherein the weight of the hammer member is adjusted by a shape of said hammer member.

7. The keyboard apparatus according to claim 1, wherein a body of the transmission member has a plate portion and plural rib portions formed on the plate portion, the plate portion and the plural rib portions forming a single component of a synthetic resin.

8. The keyboard apparatus according to claim 7, wherein the weight of the transmission member is adjusted based on a shape of the plate portion and a density of the rib portions to be formed on the plate portion.

9. A keyboard instrument comprising:

plural keys;

plural transmission members provided for the plural keys respectively, each having one of plural kinds of weights, each of which displaces, when a corresponding key is pressed by a user;

plural hammer members provided for the plural keys respectively, each having one of plural kinds of weights, each of which swings in accordance with displacement of the corresponding transmission member, when the corresponding key is pressed by the user, thereby applying an action load onto the pressed key;

plural switch units provided for the plural hammer members respectively, each of which generates an on-signal when pressed in response to swing of the corresponding hammer member; and a sound source which generates a musical signal in response to the on-signal generated by the switch unit.

10. The keyboard instrument according to claim 9, wherein when a weight of one hammer member corresponding to one of the transmission members is lighter than the other hammer member corresponding to the other transmission member, the weight of the one transmission member is made heavier than the other transmission member.

11. The keyboard instrument according to claim 9, wherein inertia moments of the weights of the hammer members are set lower in a high-pitched tone side than in a low-pitched tone side.

12. The keyboard instrument according to claim 9, wherein the plural hammer members are made lighter in weight in a high-pitched tone side than in a low-pitched tone side, and the plural transmission members are made heavier in weight in the high-pitched tone side than in the low-pitched tone side, compensating difference in weights of the hammer members between the high-pitched tone side and the low-pitched tone side, whereby initial loads of the respective keys are kept approximately constant.

13. The keyboard instrument according to claim 9, wherein the hammer member consists of a hammer portion and a hammer arm, the hammer portion and the hammer arm forming a single component of a synthetic resin.

14. The keyboard instrument according to claim 13, wherein the weight of the hammer member is adjusted by a shape of said hammer member.

15. The keyboard instrument according to claim 9, wherein a body of the transmission member has a plate portion and plural rib portions formed on the plate portion, the plate portion and the plural rib portions forming a single component of a synthetic resin.

16. The keyboard instrument according to claim 15, wherein the weight of the transmission member is adjusted based on a shape of the plate portion and a density of the rib portions to be formed on the plate portion.

* * * * *